US006951160B2

(12) United States Patent
Wu

(10) Patent No.: US 6,951,160 B2
(45) Date of Patent: Oct. 4, 2005

(54) CUTTING DEVICE FOR SPRING MANUFACTURING MACHINES

(76) Inventor: David Wu, No. 66, Lane 642, Tung Wan Shou Rd., Gueishan Hsiang, Taoyuan Hsien (TW)

( * ) Notice: Subject to any disclaimer, the term of this patent is extended or adjusted under 35 U.S.C. 154(b) by 105 days.

(21) Appl. No.: 10/623,765

(22) Filed: Jul. 22, 2003

(65) Prior Publication Data

US 2005/0016348 A1 Jan. 27, 2005

(51) Int. Cl.[7] ..... B26D 1/45
(52) U.S. Cl. ..... 83/628; 83/644; 83/950
(58) Field of Search ..... 83/602, 628, 644, 83/646, 647; 140/139, 140

(56) References Cited

U.S. PATENT DOCUMENTS 2,580,055 A * 12/1951 Weber ..... 470/125
3,082,655 A * 3/1963 Voigt ..... 83/135
3,934,445 A * 1/1976 Lampietti ..... 72/129
5,816,091 A * 10/1998 Sautter et al. ..... 72/145
6,178,862 B1 1/2001 Liao

* cited by examiner

*Primary Examiner*—Kenneth E. Peterson

(57) ABSTRACT

A cutting device for spring manufacturing machines includes an actuator, a transmission mechanism and a sliding mechanism. The actuator includes a connecting rod with a pin hole formed therein. The sliding mechanism includes a track, a slider and a switching pin. The slider includes an axial hole and slidably moves back and forth in the track. The switching pin can be inserted through or removed from the axial hole and the pin hole so that the cutting device can perform either a linear direction or an oval trace cutting in a coil spring winding machine.

9 Claims, 8 Drawing Sheets

CUTTING DEVICE FOR SPRING MANUFACTURING MACHINES

BACKGROUND OF THE INVENTION

The present invention relates generally to a cutting device for spring manufacturing machines and, more particularly, to a cutting device including an actuator connecting a slider and a blade mounted on the slider to perform either a linear direction or an oval trace cutting in coil spring winding machines.

It is well-known a spring, such as a coil winding spring, is widely used as an absorber in cars, toys, appliances, switches and etc. As the spring elements are necessitated for various mechanical and electronic devices, the spring manufacturing machines keep continually to enhance the quality and yield rate of the spring production. For example, the U.S. Pat. No. 6,178,862 discloses a cutting tool assembly in coil spring winding machines, as shown in FIG. 1, including a tool track 10*a*, a transmission mechanism 20*a*, a sliding seat 30*a* and a guiding seat 40*a*. This assembly uses the sliding seat 30*a* and the guiding seat 40*a* for the cutting in a vertical direction. To do the cutting in a progressive tilt direction, the guiding seat 40*a* is dismantled and the sliding seat 30*a* may be replaced by another sliding seat to fix the slider therein.

However, this conventional cutting tool assembly has the drawbacks as follows.

1. To do the cutting in the progressive tilt direction, the guiding seat 40*a* has to be dismantled from the assembly and replace the sliding seat 30*a*. It always needs a precise adjustment of the machine after the assembly is changed. Also it takes time and needs a technician to complete the dismantlement and replacement. Therefore, under a highly changing frequency of the sliding and guiding seats 30*a*, 40*a* in the coil spring winding machines, the producing efficiency may be reduced. Besides, the sliding and guiding seats 30*a*, 40*a* may be easy to get worn in such changes.

2. The sliding seat 30*a* is connected to the tool track 10*a* by several screws 31*a* fixed therein. Nevertheless, this kind of screw fixation cannot provide a precise connection. Furthermore, the slider of the tool track 10*a* is suspended and a dynamic loading due to the movement of the slider of the sliding seat 30*a* is also endured by the screws 31*a*. Therefore, it may be easy to get broken in the connection. Next, in order to adjust the cutting point of the blade, the screws 31*a* have to be unscrewed first, and a retaining nut 111*a* is used to relocate the position of the slider of the tool track 10*a*. Therefore, it may be not so convenient for the adjustment.

Therefore, there exist inconvenience and drawbacks for practically application of the above conventional cutting tool assembly in coil spring winding machines. There is thus a substantial need to provide an improved cutting device for spring manufacturing machines that resolves the above drawbacks and can be used more conveniently and practically.

BRIEF SUMMARY OF THE INVENTION

It is therefore an object of the present invention to provide an improved cutting device for spring manufacturing machines to perform either a linear direction or an oval trace cutting operation by simply using a switching pin.

Another object of the present invention is to provide an improved cutting device for spring manufacturing machines with an easy assembly and precise structure to reduce the producing and maintaining cost and increase the efficiency and yield rate of spring manufacturing machines.

Still another object of the present invention is to provide an improved cutting device for spring manufacturing machines to exactly adjust a cutting point of a blade by simply turning a knob.

In order to achieve the above-mentioned objects, the cutting device for spring manufacturing machines includes an actuator, a transmission mechanism and a sliding mechanism. The actuator includes a base with a shaft opening, and a connecting rod with a pin hole and a pivot hole fixedly mounted to the base. The transmission mechanism includes a driving shaft furnished in the shaft opening to drive the actuator in an eccentric revolving movement. The sliding mechanism includes a track, a positioning shaft, a blade adjusting block, a slider, a switching pin, a connecting pivot and a blade. The positioning shaft and the blade adjusting block are fixed on the track. The slider including a first and a second axial holes linearly moves back and forth in the track. The connecting pivot is inserted through the first axial hole and the pivot hole to connect the slider and the connecting rod. The blade is connected to the slider. Thereby when the switching pin is inserted through the second axial hole of the slider and the pin hole of the connecting rod, the track will swing with respect to the positioning shaft so that the blade will perform an oval trace cutting operation under the linear movement of the slider and the swing of the track, and when the switching pin is removed, the track is fixed so that the blade will perform an linear direction cutting operation.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
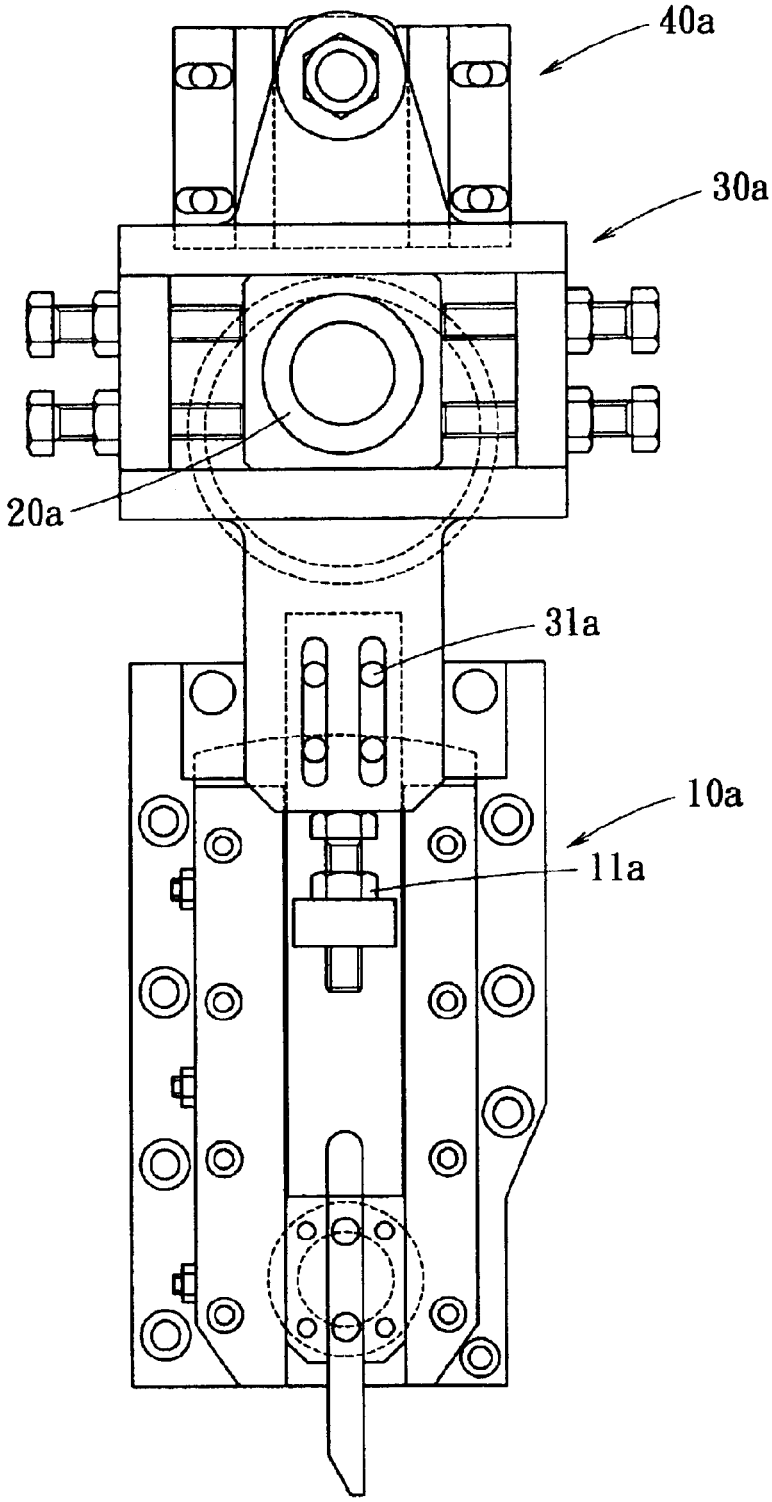
FIG. 1 PRIOR ART
FIG. 1 shows a front view of a conventional cutting tool assembly in spring winding machines.
Figure 2:
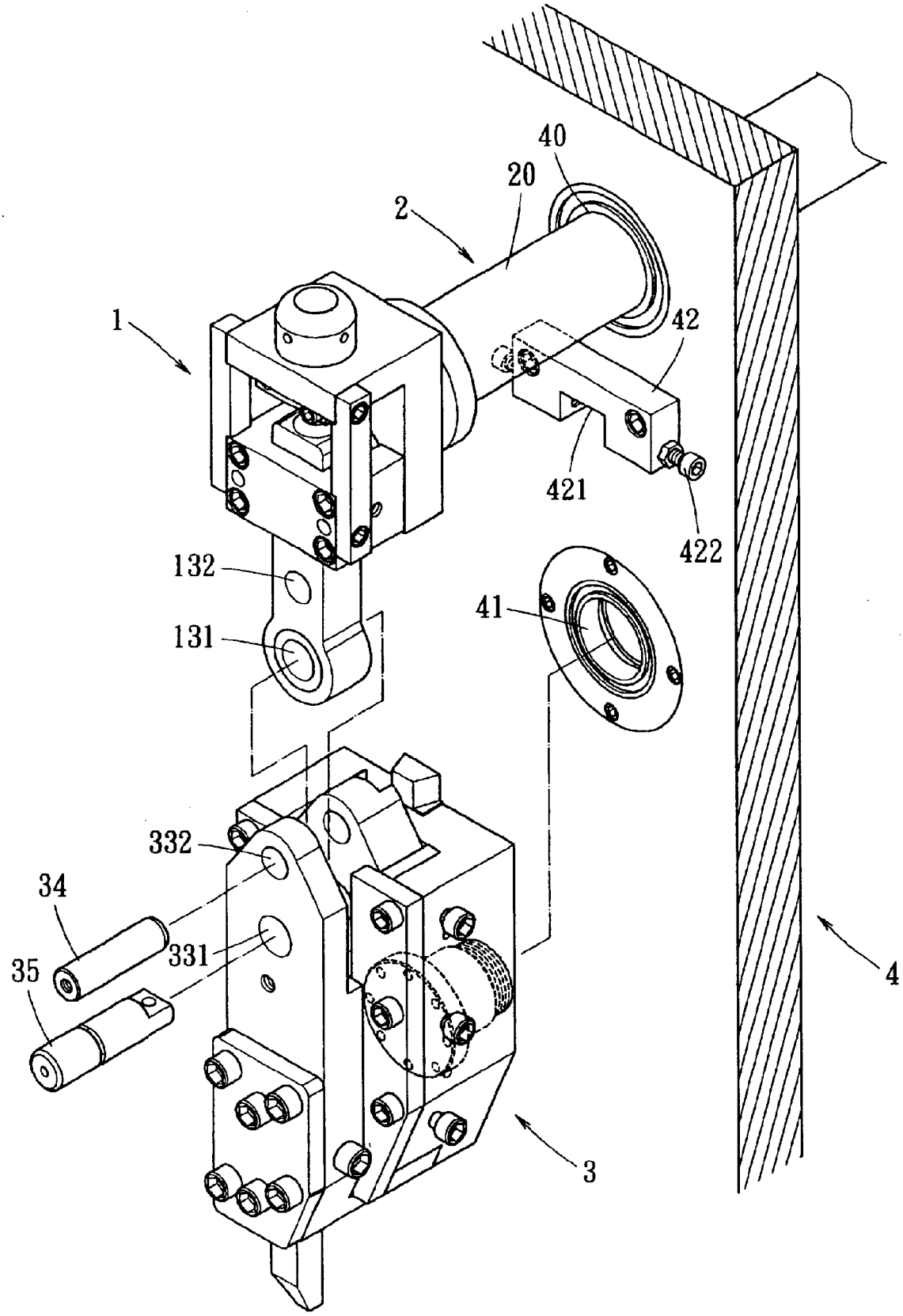
FIG. 2 shows a perspective view of connecting an actuator and a sliding mechanism of a cutting device for spring manufacturing machines according to the present invention.
Figure 3:
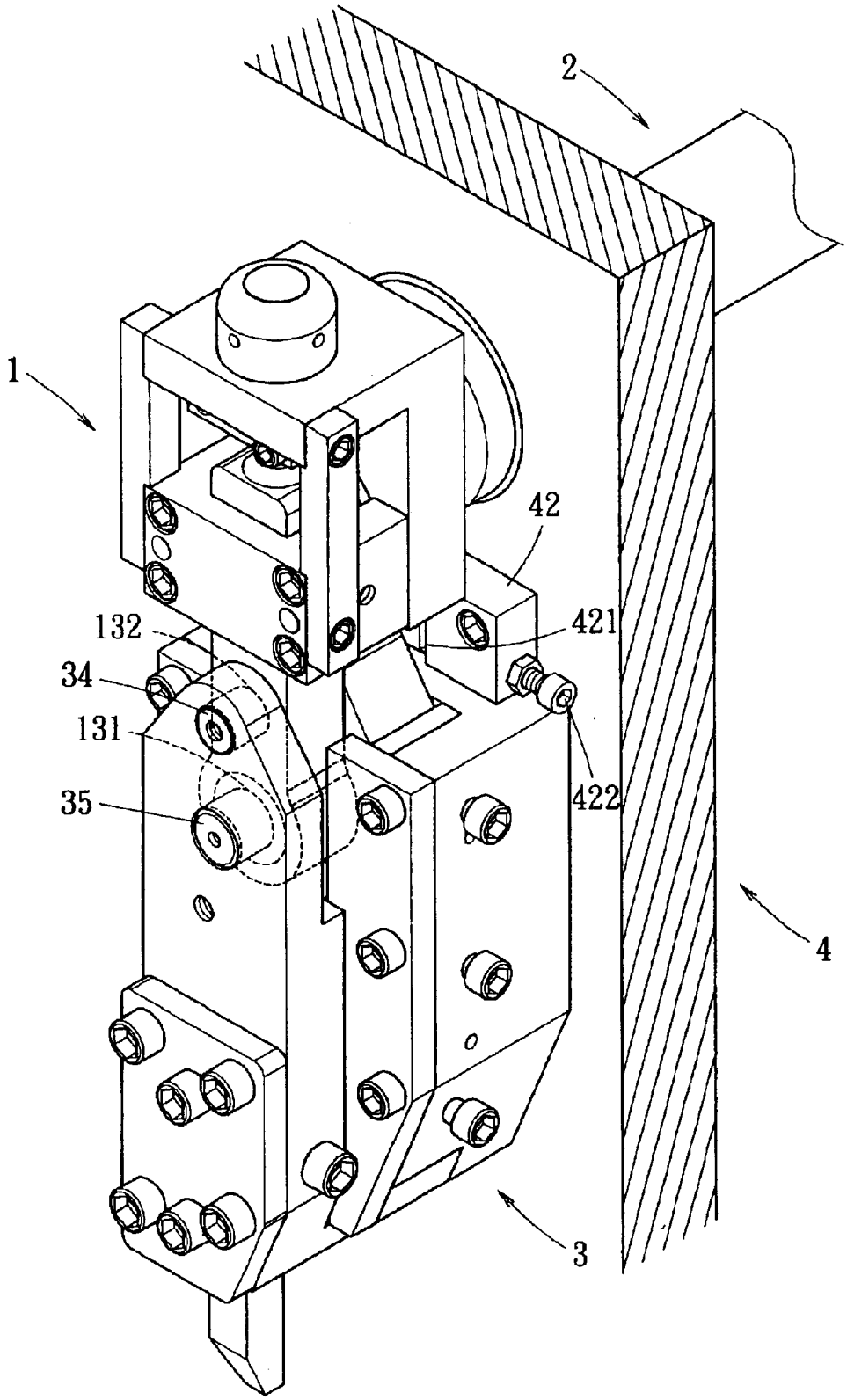
FIG. 3 shows a perspective view of the assembly in FIG. 2.

Referring to FIGS. 2 and 3, the present invention provides a cutting device for spring manufacturing machines including an actuator 1, a transmission mechanism 2, a sliding mechanism 3 and a machine plate 4.

Figure 4:
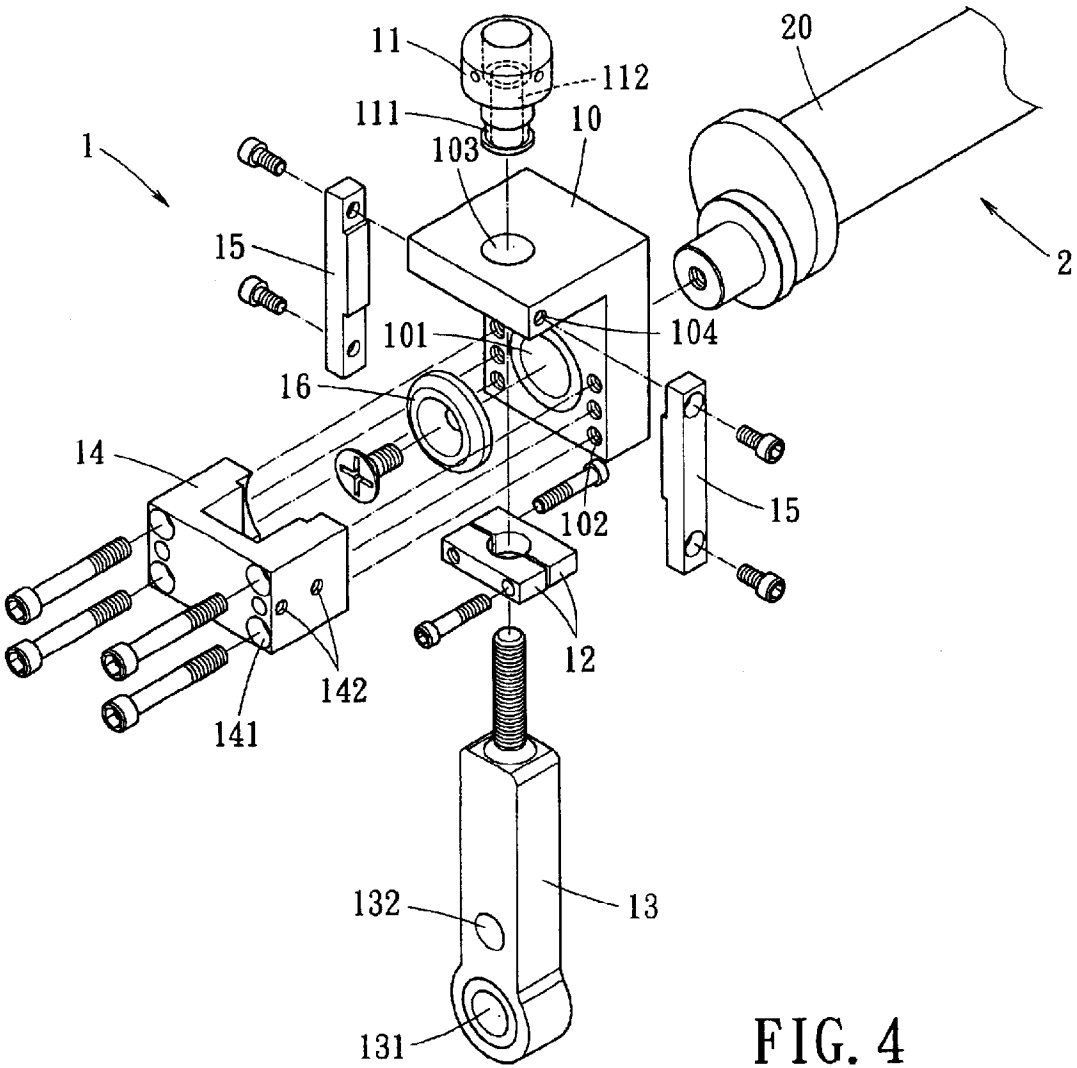
FIG. 4 shows an exploded view of the actuator.

As shown in FIG. 4, the actuator 1 includes a base 10, a blade adjusting knob 11, a fixing block 12, a connecting rod 13, a fixing seat 14, a fixing plate 15 and a shaft cap 16. The L-shaped base 10 includes a shaft opening 101 and a plurality of threaded holes 102. A driving shaft 20 with an eccentric cam of the transmission mechanism 2 is fixedly furnished in the shaft opening 101 with the cap 16 covered thereon. The knob 11 is mounted in a through hole 103 of the base 10. The knob 11 is a stepped cylinder with an annular recess 111 on the bottom portion to engage with the fixing block 12. A threaded hole 112 is formed in the bottom end of the knob 11 for one threaded end of the connecting rod 13 to be screwed therein. The connecting rod 13 has a substantial rectangular shape with a pivot hole 131 and a pin hole 132 formed therein. The connecting rod 13 is precisely fitted in the fixing seat 14. The substantial U-shaped fixing seat 14 includes a plurality of through holes 141 for the screws to pass through to screw in the corresponding threaded holes 102 so that the connecting rod 13 is fixedly secure by the base 10 and the fixing seat 14.

Furthermore, another threaded holes 104 and 142 are formed in two sides of the base 10 and the fixing seat 14, respectively. The fixing plate 15 is then fixed on two sides of the base 10 and the fixing seat 14 to further secure the connecting rod 13.

Figure 5:
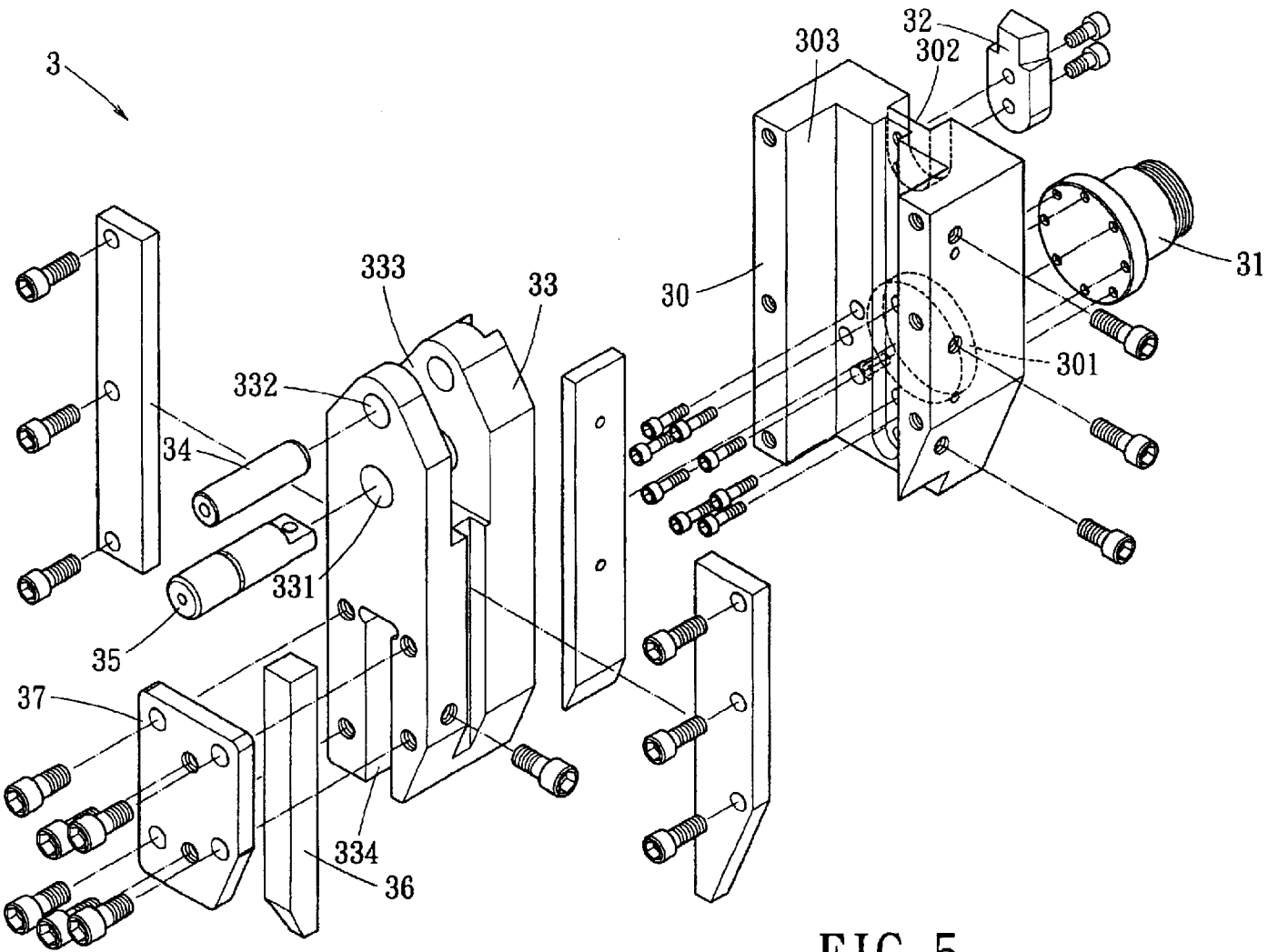
FIG. 5 shows an exploded view of the sliding mechanism.

As shown in FIG. 5, the sliding mechanism 3 includes a track 30, a positioning shaft 31, a blade adjusting block 32, a slider 33, a switching pin 34, a connecting pivot 35, a blade 36 and a cover plate 37. The track 30 includes a circular recess 301 and a slot 302 on the back thereof for locating the position shaft 31 and the blade adjusting block 32, respectively. A sliding groove 303 is formed in the front of the track 30 for the slider 33 moving therein. The slider 33 includes a first and second axial holes 331 and 332 in the top portion thereof for inserting the connecting pivot 35 and the switching pin 34, respectively. A recess 333 is also formed in the top portion of the slider 33 for locating the connecting rod 13. The blade 36 is fixedly mounted in a groove 334 formed in the front surface of the bottom portion of the slider 31, and is covered by the cover plate 37.

The machine plate 4 includes a first and a second shaft holes 40 and 41. The driving shaft 20 is pivotably furnished through the first shaft hole 40, and the position shaft 31 is pivotably furnished in the second shaft hole 41. A blade adjusting seat 42, including a recess 421 in the bottom thereof and two bolts 422 on two opposite sides, is mounted on the machine plate 4 between two shaft holes 40, 41. The top portion of the blade adjusting block 32 is received in the recess 421 after the sliding mechanism 3 is mounted on the machine plate 4 by the position shaft 31. Meanwhile, the connecting rod 13 is located in the recess 333 and pivotably connected to the slider 33 by the connecting pivot 331.

Figure 6:
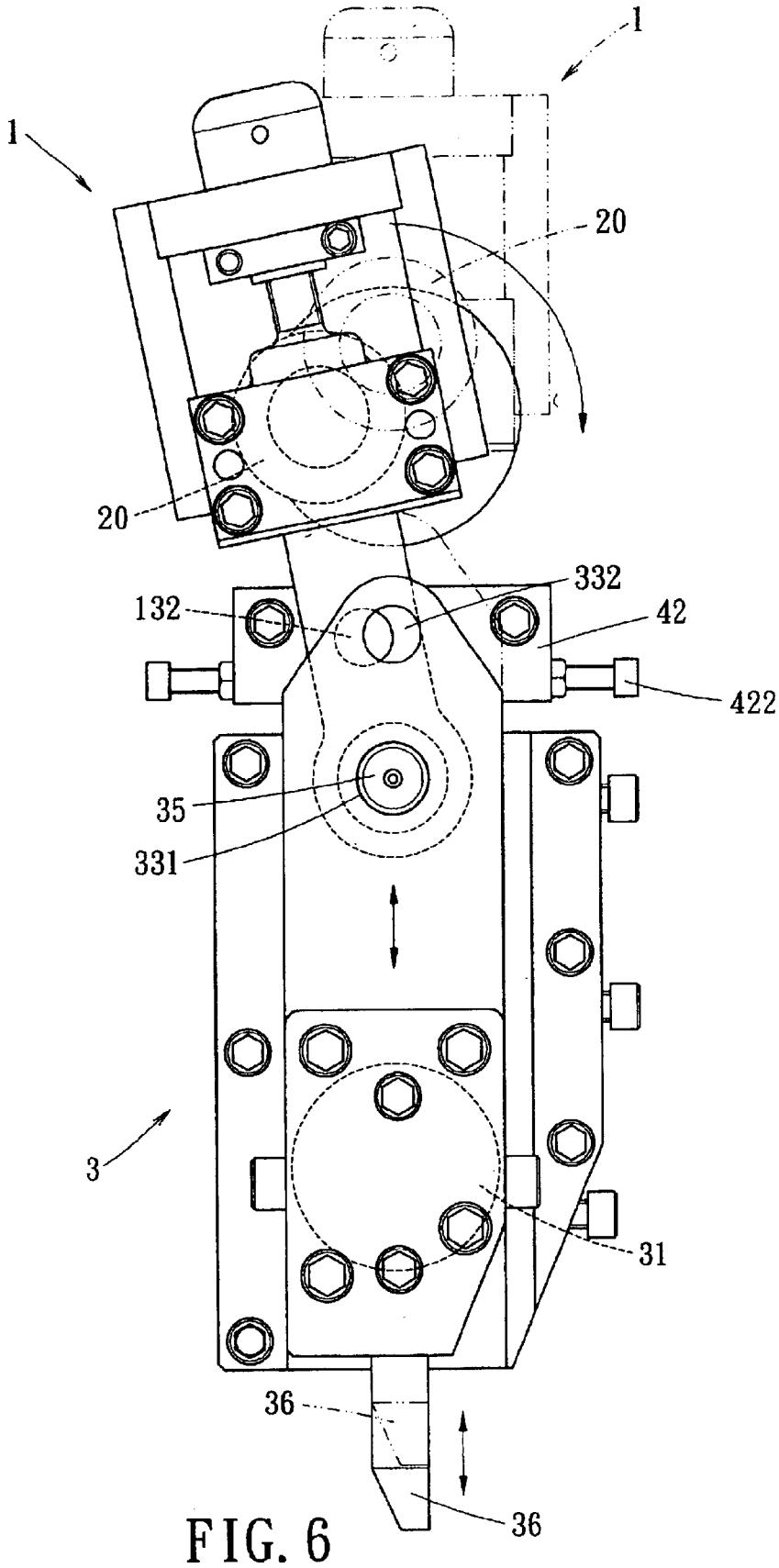
FIG. 6 shows a first cutting operation of the present invention.

A first cutting operation of the present invention is shown in FIG. 6. The switching pin 34 is not inserted into the second axial hole 332 of the slider 33 and the pin hole 132 of the connecting rod 13. The bolts 422 of the blade adjusting seat 42 are adjusted to clamp the blade adjusting block 32; therefore, the track 30 is fixed. The driving shaft 20 of the transmission mechanism 2 drives the actuator 1 revolving with respect to the driving shaft 20. The connecting rod 13 then actuates the slider 31 with a linear movement in the track 30; therefore, the blade 36 can perform a vertical direction cutting in coil spring winding machines. Furthermore, in order to adjust the cutting point of the blade 36 in the present invention, it is much easier to be achieved merely by turning the knob 11.

Figure 7:
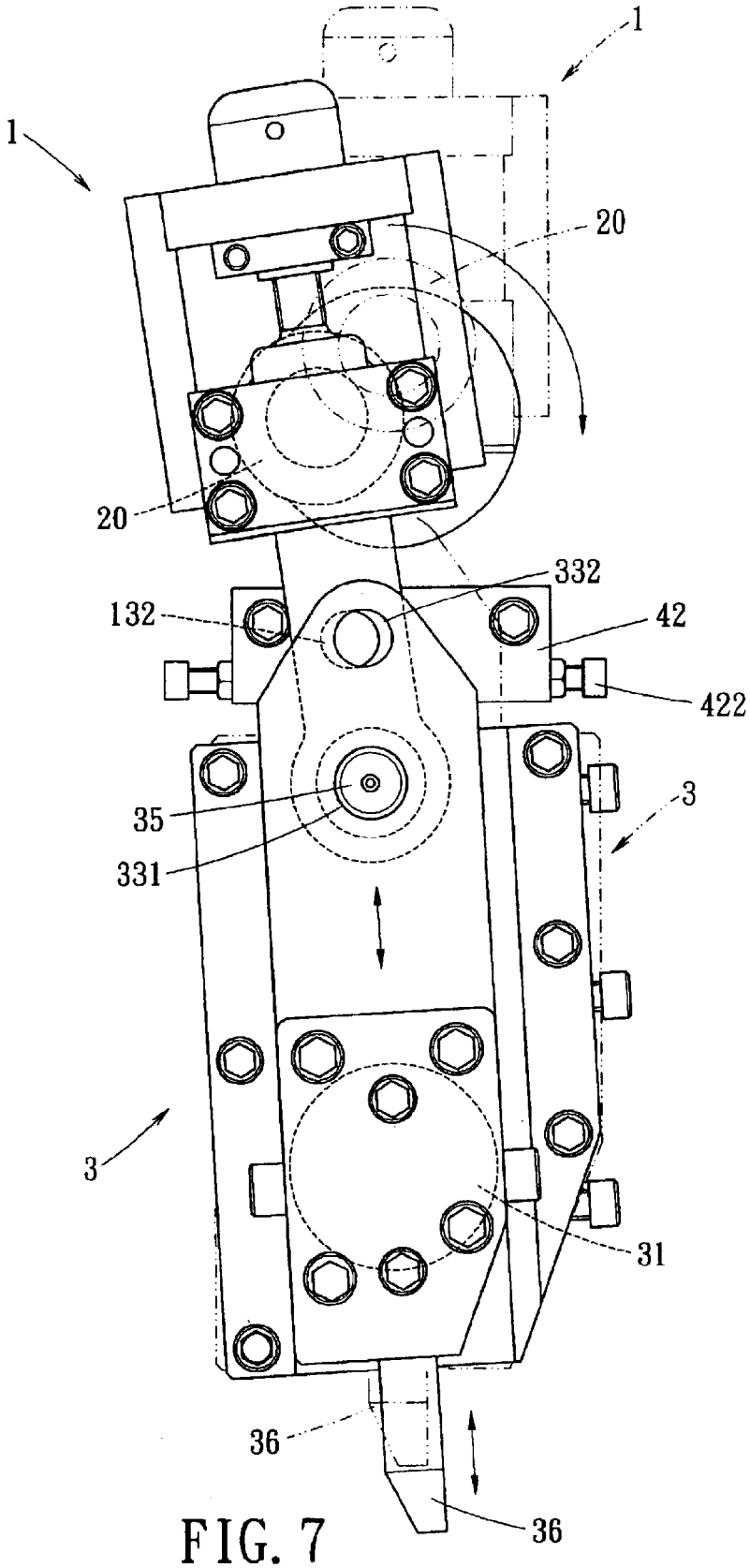
FIG. 7 shows a second cutting operation of the present invention.

Refer to FIG. 7, it can further obtain a second cutting operation of the present invention via the blade adjusting seat 42 in FIG. 6. When the switching pin 34 is still removed from the cutting device, the bolts 422 are be correspondingly adjusted to tilt the track 30 with respect to the positioning shaft 31 through the blade adjusting block 32. Therefore, the blade 36 can perform a linear but tilt direction cutting in coil spring winding machines.

Figure 8:
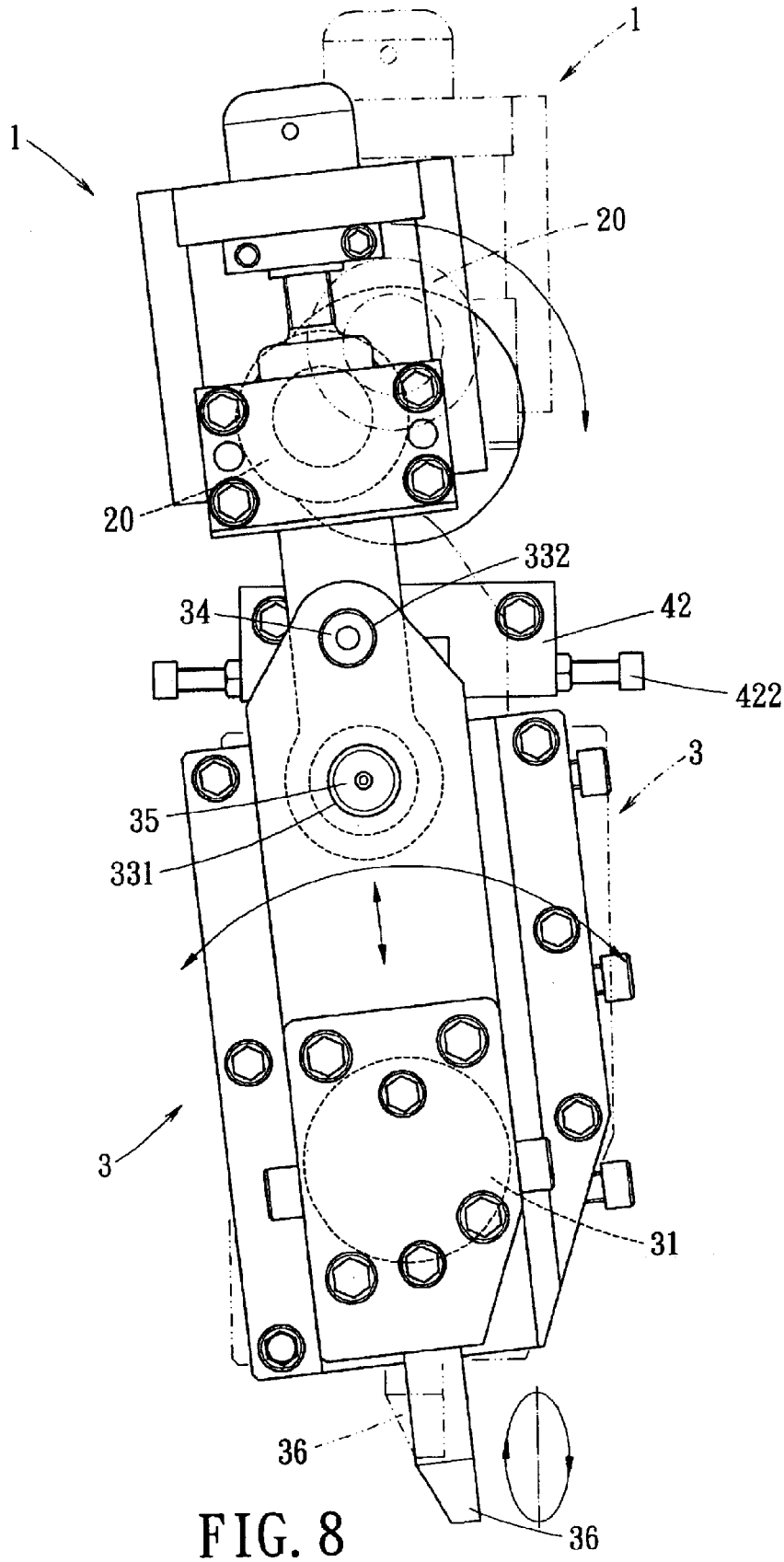
FIG. 8 shows a third cutting operation of the present invention.

A third cutting operation of the present invention is shown in FIG. 8. When the switching pin 34 is inserted into the second axial hole 332 of the slider 33 and the pin hole 132 of the connecting rod 13, the slider 33 of the sliding mechanism 3 is still actuated by the connecting rod 13 of the actuator 1 to linearly move back and forth in the track 30. Meanwhile, the bolts 422 of the blade adjusting seat 42 are adjusted not to clamp the blade adjusting block 32. Due to the positioning shaft 31 of the sliding mechanism 3 is pivotably furnished in the second shaft hole 41 of the machine plate 4, the track 30 will swing with respect to the positioning shaft 31. Therefore, the blade 36 can perform an oval trace cutting in coil spring winding machines.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A cutting device for spring manufacturing machines, comprising:

an actuator including a base with a shaft opening, and a connecting rod with a pin hole and a pivot hole fixedly mounted to the base;

a transmission mechanism including a driving shaft furnished in the shaft opening to drive the actuator in an eccentric revolving movement; and a sliding mechanism including a track, a positioning shaft, a blade adjusting block, a slider, a switching pin, a connecting pivot and a blade, the positioning shaft and the blade adjusting block being fixed on the track, the slider including a first and a second axial holes, and being linearly moving back and forth in the track, the connecting pivot being inserted through the first axial hole and the pivot hole to connect the slider and the connecting rod, and the blade being connected to the slider;

thereby when the switching pin is inserted through the second axial hole of the slider and the pin hole of the connecting rod, the track will swing with respect to the positioning shaft so that the blade will perform an oval trace cutting operation under the linear movement of the slider and the swing of the track, and when the switching pin is removed, the track is fixed so that the blade will perform a linear direction cutting operation.

2. The cutting device of claim 1, wherein the actuator includes a blade adjusting knob to be mounted in a through hole of the base for adjusting a cutting point of the blade, and a fixing seat fixed to the base to secure the connecting rod.

3. The cutting device of claim 2 wherein the blade adjusting knob has a thread hole formed in the bottom thereof for one threaded end of the connecting rod to be screwed therein, so that the cutting point of the blade is adjusted by turning the blade adjusting knob.

4. The cutting device of claim 2, wherein the fixing seat is substantially U-shaped for fitting the connecting rod.

5. The cutting device of claim 1, wherein the actuator includes a cap, and the driving shaft with an eccentric cam is fixedly furnished in the shaft opening with the cap covered thereon.

6. The cutting device of claim 1, wherein the sliding mechanism includes a cover plate, and the blade is fixedly mounted in a groove formed in the front surface of the bottom portion of the slider and is covered by the cover plate.

7. The cutting device of claim 1, further comprising a machine plate with a first and a second shaft hole, the driving shaft is pivotably furnished through the first shaft hole, and the position shaft is pivotably furnished in the second shaft hole.

8. The cutting device of claim 7, further comprising a blade adjusting seat mounted on the machine plate, including a recess for receiving the blade adjusting block and two bolts for clamping the blade adjusting block to fix the track when the switching pin is removed, and not clamping the blade adjusting block when the switching pin is inserted.

9. The cutting device of claim 7, wherein the bolts are adjusted to tilt the track with respect to the positioning shaft through the blade adjusting block when the switching pin is removed.

* * * * *